US007762374B2

(12) United States Patent
Turner et al.

(10) Patent No.: US 7,762,374 B2
(45) Date of Patent: Jul. 27, 2010

(54) TURBINE ENGINE DIFFUSING EXHAUST MUFFLER

(75) Inventors: Jeffrey A. Turner, Chandler, AZ (US); Yogendra Y. Sheoran, Scottsdale, AZ (US); Bruce D. Bouldin, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 787 days.

(21) Appl. No.: 11/603,424

(22) Filed: Nov. 22, 2006

(65) Prior Publication Data

US 2008/0118347 A1 May 22, 2008

(51) Int. Cl.
*F01N 13/04* (2010.01)

(52) U.S. Cl. ..... 181/239; 181/213; 181/238; 415/119; 244/1 N

(58) Field of Classification Search ..... 181/210, 181/211, 212, 213, 215, 238, 239; 415/119; 224/1 N See application file for complete search history.

(56) References Cited

U.S. PATENT DOCUMENTS 700,785 A * 5/1902 Kull ..... 181/239
2,865,169 A * 12/1958 Hausmann ..... 239/265.27
2,973,825 A * 3/1961 Bertin ..... 181/220
3,185,252 A 5/1965 Lemmerman
3,243,125 A * 3/1966 Latulippe ..... 239/265.25
3,437,173 A * 4/1969 Ehrich ..... 181/213
3,572,466 A * 3/1971 Hom et al. ..... 181/220
3,575,261 A * 4/1971 Medawar et al. ..... 181/220
3,587,777 A * 6/1971 Ellis ..... 181/220
3,587,778 A * 6/1971 Beach et al. ..... 181/216
3,614,037 A * 10/1971 Vdolek ..... 244/110 B
3,650,348 A * 3/1972 Colebrook et al. ..... 181/215
3,743,185 A * 7/1973 FFowces-Williams et al. ..... 239/265.27
3,747,874 A * 7/1973 Johnsen ..... 244/53 R
4,102,499 A * 7/1978 Hall ..... 239/265.27
4,128,769 A 12/1978 Bons et al.
4,180,141 A 12/1979 Judd
4,244,441 A 1/1981 Tolman
4,577,462 A * 3/1986 Robertson ..... 60/262
4,645,032 A 2/1987 Ross et al.
4,747,467 A 5/1988 Lyon et al.
4,874,062 A 10/1989 Yanagida et al.
4,892,168 A 1/1990 Sasaki et al.
4,979,587 A 12/1990 Hirt et al.
5,162,620 A 11/1992 Ross et al.
5,428,954 A * 7/1995 Cowan, Sr. ..... 60/262

(Continued)

*Primary Examiner*—Jeffrey Donels
*Assistant Examiner*—Jeremy Luks
(74) *Attorney, Agent, or Firm*—Ingrassia Fisher & Lorenz, P.C.

(57) ABSTRACT

An exhaust muffler is provided for a turbine engine with at least first and second exhaust outlets. The exhaust muffler includes a first arm configured to be coupled to the first exhaust outlet of the turbine engine. The first arm includes an outer surface, and an inner surface that defines a first exhaust cavity. The first arm further includes a plurality of perforations extending between the inner and outer surfaces. The exhaust muffler further includes a second arm coupled to the first arm and configured to be coupled to the second exhaust outlet of the turbine engine. The second arm includes an outer surface, and an inner surface that defines a second exhaust cavity. The second arm also includes a plurality of perforations extending between the inner and outer surfaces.

15 Claims, 4 Drawing Sheets

U.S. PATENT DOCUMENTS 5,685,157 A * 11/1997 Pandalai et al. ..... 60/725
5,717,172 A * 2/1998 Griffin et al. ..... 181/215
5,821,472 A * 10/1998 Zwernemann ..... 181/215
5,844,178 A 12/1998 Lothringen
6,102,154 A 8/2000 Liu et al.
6,615,576 B2 9/2003 Sheoran et al.
6,640,537 B2 11/2003 Tse
6,672,424 B2 1/2004 Gadefait et al.
6,695,094 B2 2/2004 Moffat et al.
6,918,463 B2 7/2005 Takahashi et al.
6,959,782 B2 11/2005 Brower et al.
2005/0188673 A1 9/2005 Nishimura et al.

* cited by examiner

TURBINE ENGINE DIFFUSING EXHAUST MUFFLER

STATEMENT REGARDING FEDERALLY SPONSORED RESEARCH OR DEVELOPMENT

This invention was made with Government support under contract number HR0011-05-C-0043 awarded by Defense Advanced Research Projects Agency (DARPA). The Government has certain rights in this invention.

FIELD OF THE INVENTION

The present invention generally relates to an exhaust muffler, and more particularly relates to an exhaust muffler for an aircraft with a bifurcated exhaust system.

BACKGROUND OF THE INVENTION

Gas turbine engines are utilized to power aircraft, including unmanned aerial vehicles (UAV). The gas turbine engines of UAVs typically include an exhaust system with one or more outlets that exhaust gases from the engines directly into the atmosphere. This arrangement can result in noise levels that may exceed government standards.

Attempts to provide an exhaust muffler on the UAV are often unsuccessful, particularly due to the compact and aerodynamic design of the UAV. These attempts can be further frustrated because exhaust mufflers should preferably attenuate not only noise from the turbine in the engine, but also noise from the combustion gases emanating from the engine. Exhaust mufflers that satisfactorily muffle the engine noise can cause external drag on the UAV or result in additional, undesireable weight.

Accordingly, it is desirable to have an exhaust muffler that satisfactorily attenuates engine noise as a result of turbine noise and combustion noise in a compact design. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

An exhaust muffler is provided for a turbine engine with at least first and second exhaust outlets. The exhaust muffler includes a first arm configured to be coupled to the first exhaust outlet of the turbine engine. The first arm includes an outer surface, and an inner surface that defines a first exhaust cavity. The first arm further includes a plurality of perforations extending between the inner and outer surfaces. The exhaust muffler further includes a second arm coupled to the first arm and configured to be coupled to the second exhaust outlet of the turbine engine. The second arm includes an outer surface, and an inner surface that defines a second exhaust cavity. The second arm also includes a plurality of perforations extending between the inner and outer surfaces.

A method is provided for manufacturing an exhaust muffler for a turbine engine with at least first and second exhaust outlets. The method includes providing a first arm configured to be coupled to the first exhaust outlet of the turbine engine, the first arm including an outer surface, and an inner surface that defines a first exhaust cavity. The first arm further includes a plurality of perforations extending between the inner and outer surfaces. The method further includes providing a second arm coupled to the first arm and configured to be coupled to the second exhaust outlet of the turbine engine, the second arm including an outer surface, and an inner surface that defines a second exhaust cavity. The second arm further includes a plurality of perforations extending between the inner and outer surfaces.

A method is provided for mounting an exhaust muffler to a turbine engine with at least first and second exhaust outlets. The method includes coupling a first arm to the first exhaust outlet of the turbine engine, the first arm including an outer surface, and an inner surface that defines a first exhaust cavity. The first arm further includes a plurality of perforations extending between the inner and outer surfaces. The method further includes coupling a second arm to the first arm and the second exhaust outlet of the turbine engine. The second arm includes an outer surface, and an inner surface that defines a second exhaust cavity. The second arm further includes a plurality of perforations extending between the inner and outer surfaces.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
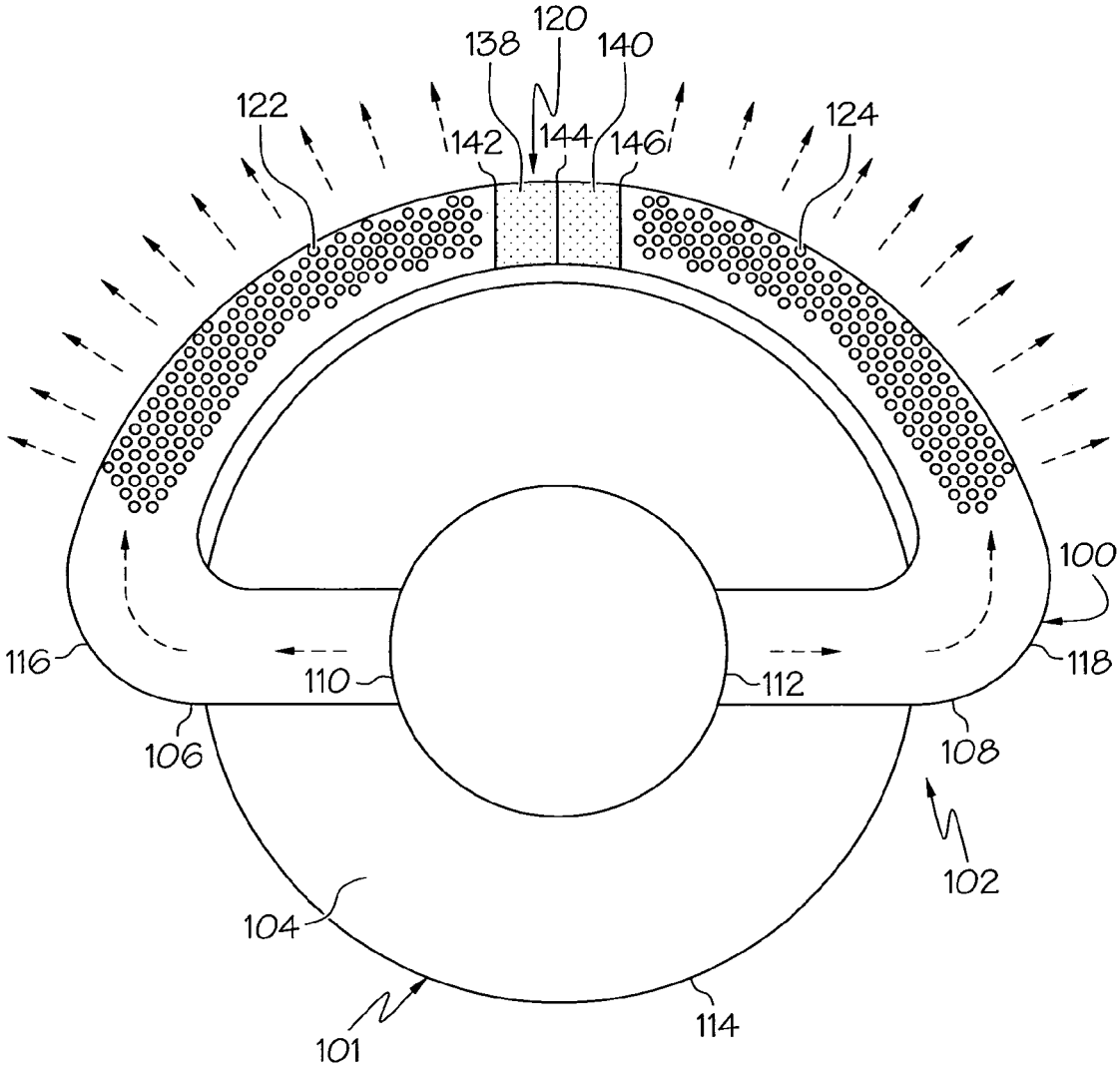
FIG. 1 is a top, plan schematic representation of one embodiment of an exhaust muffler.
Figure 2:
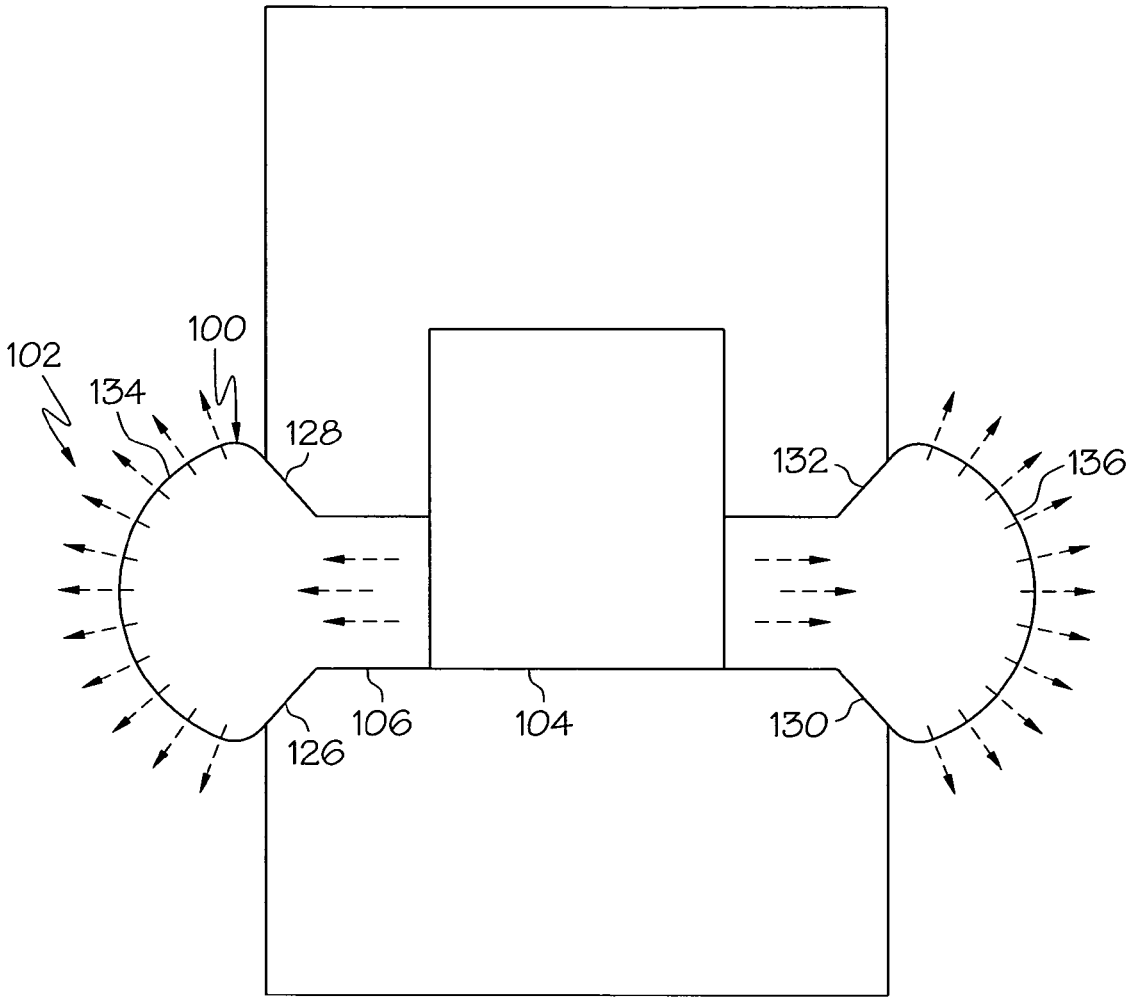
FIG. 2 is a side, rear schematic representation of the exhaust muffler of FIG. 1.
Figure 3:
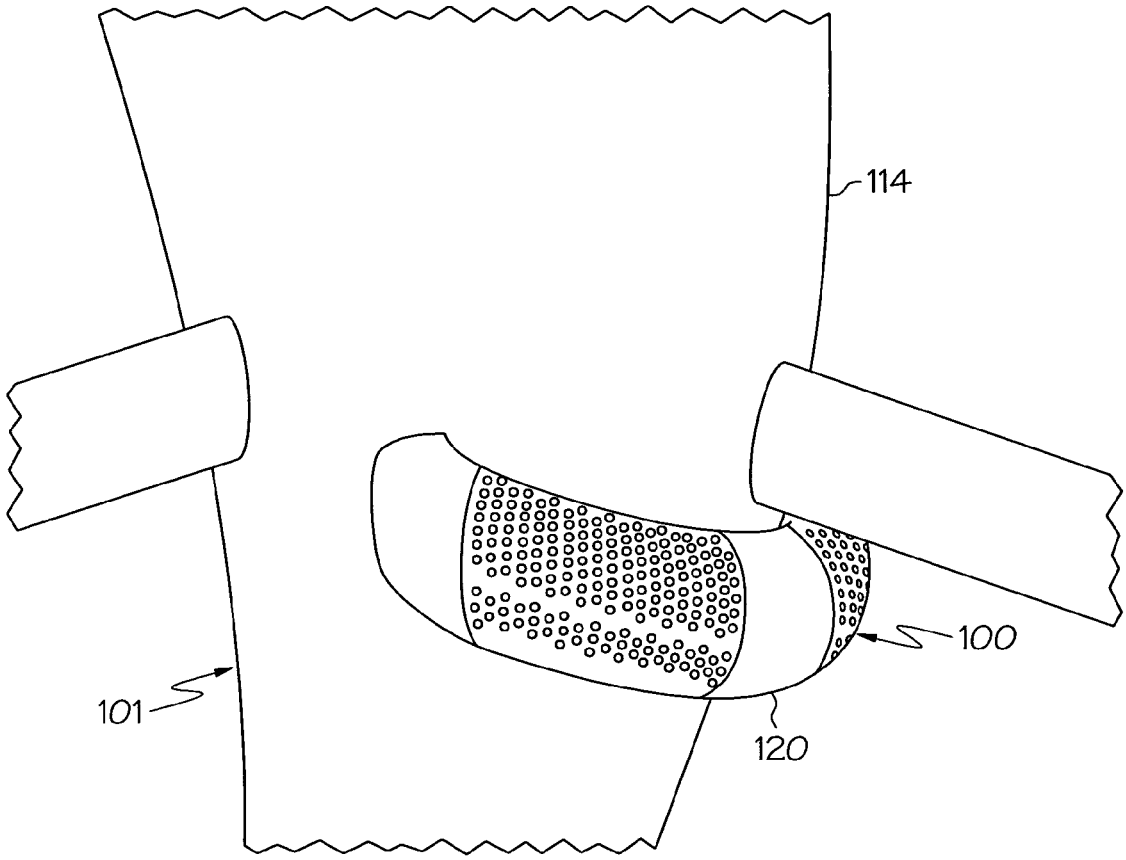
FIG. 3 is a top, side perspective view of one embodiment of an exhaust muffler mounted on an aircraft.
Figure 4:
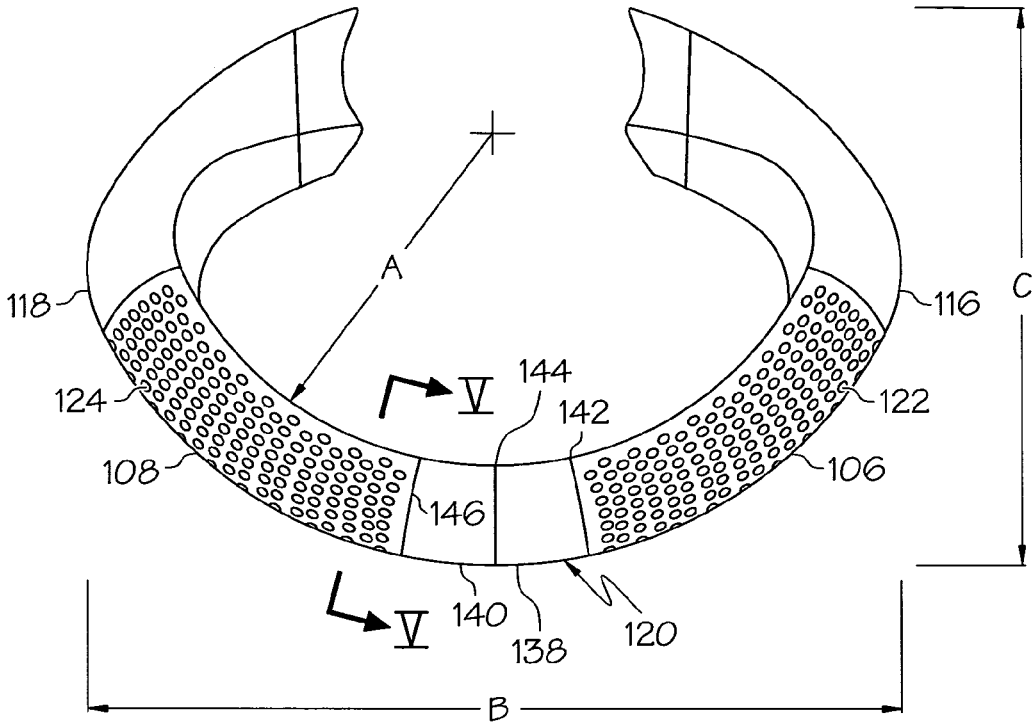
FIG. 4 is a top, front perspective view of the exhaust muffler of FIG. 3 separated from the aircraft.
Figure 5:
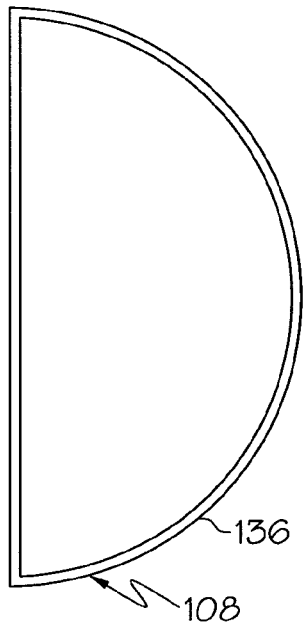
FIG. 5 is a cross-sectional view of the exhaust muffler of FIG. 4 through line V-V.

FIG. 1 is a top, schematic representation of an exemplary exhaust muffler 100, and FIG. 2 is a side, rear schematic representation of the exhaust muffler 100. FIG. 3 is a top, side perspective view of one embodiment of the exhaust muffler 100 mounted on an aircraft 101, and FIG. 4 is a top, front perspective view of the exhaust muffler 100 of FIG. 3 separated from the aircraft 101. FIG. 5 is a cross-sectional view of the exhaust muffler of FIG. 4 through line V-V. For the purpose of this detailed description, the structure and operation of the exhaust muffler 100 will be described using all of FIGS. 1-5 since different components and views are shown in each of the FIGS.

One embodiment of the exhaust muffler 100 is utilized with a bifurcated exhaust system 102 for a turbine engine 104 of the aircraft 101. The aircraft 101 can be, for example, an unmanned aerial vehicle (UAV). Although the illustrated embodiment is a bifurcated exhaust system 102, the exhaust muffler 100 can be utilized with an exhaust system with more than two exhaust outlets, for example, three or four exhaust outlets. The exhaust muffler 100 has two arms 106, 108 that couple to exhaust outlets 110, 112 of the turbine engine 104. The arms 106, 108 define cavities for exhaust flow. The arms 106, 108 extend outwardly from the turbine engine 104 and out of a fuselage 114 of the aircraft 101. In the illustrated embodiment, the arms 106, 108 of the exhaust muffler 100 extend from opposite sides of the turbine engine 104 and are originally oriented at 180° from one another, although other arrangements can be provided.

Once outside the fuselage 114, the arms 106, 108 are respectively bent at bends 116, 118 and extend around a portion of the circumference of the fuselage 114, as best shown by FIG. 1. The two arms 106, 108 are joined together by an acoustic treatment component 120. In an alternate embodiment, the acoustic treatment component 120 is omitted and the first and second arms are coupled directly together. The arms 106, 108 include a number of perforations 122, 124 downstream of the bends 116, 118. The perforations 122, 124 vent the exhaust to the atmosphere.

In operation, exhaust exits the turbine engine 104 at the exhaust outlets 110, 112. The exhaust flows through the arms 106, 108 and out of the perforations 122, 124. The plurality of perforations 122, 124 rapidly diffuse the exhaust and reduce noise from the turbine engine 104 resulting from the exhaust. The perforations 122, 124 can be arranged in any suitable arrangement. In the illustrated embodiment, the perforations 122 on the first arm 106 are arranged in nineteen offset rows of eleven perforations. Similarly, the perforations 124 on the second arm 108 are arranged in nineteen offset rows of eleven perforations. Generally, the perforations 122, 124 are adjacent the bends 116, 118 in the arms 106, 108 and extend to adjacent the acoustic treatment component 120. The perforations 122, 124 can extend for a length of, for example, 6.1 inches along the respective arm 106, 108. The perforations 122, 124 can be sized to most efficiently exhaust the exhaust flow while attenuating the engine noise. In one embodiment, each of the perforations 122, 124 is round with a diameter of 0.2 inches, and the total area of the perforations is about 13.1 square inches. The perforations 122, 124 can be shapes other than round, and are not limited to uniform sizes or shapes.

As best shown by FIG. 2, the portion of each of the arms 106, 108 extending around the fuselage 114 includes two generally flattened portions 126, 128; 130, 132 that form one side of the arm 106, 108 and a generally rounded portion 134, 136 that forms the other side of the arm 106, 108. The two generally flattened portions 126, 128; 130, 132 gradually transition into a single flattened portion for each of the first and second arms 106, 108, as best shown in the cross-sectional view of FIG. 5.

As particularly shown in FIGS. 3 and 4, the exhaust muffler 100 can be sized to satisfactorily attenuate noise from the engine while maintaining a compact design relative to the aircraft 101. Moreover, the arms 106, 108, as well as the perforations 122, 124, can be sized to minimize internal flow loses. Referring particularly to FIG. 4, in one embodiment, the inner diameter A of the exhaust muffler can be about 5.5 inches. The outer diameter B of the exhaust muffler 100 along one axis can be about 12.7 inches, and the outer diameter C of the exhaust muffler 100 along a second axis can be about 8 inches. As best shown by FIG. 5, the cross-sectional shape of the exhaust muffler 100 along most of the portion of the arms 106, 108 with the perforations 122, 124 and the acoustic treatment component 120 is a half-circle with a radius of about 1.6 inches. The portion of the arms 106, 108 with the perforations 122, 124 and the acoustic treatment component 120 of the exhaust muffler 100 is separated from the fuselage of the UAV by about 0.25 inches to about 0.5 inches, although this distance may vary.

As noted above, the acoustic treatment component 120 couples the end of the first arm 106 to the end of the second arm 108. In the illustrated embodiment, the acoustic treatment component 120 has a cross section shaped like a half circle with a radius of about 1.6 inches and has a length of about 3.2 inches. However, the particular dimensions of the acoustic treatment component 120 can be adjusted as necessary, as discussed in further detail below. The acoustic treatment component 120 has an outer wall that is generally the same size and shape of the first and second arms 106, 108 to define one or more resonance chambers 138, 140. In the illustrated embodiment, the acoustic treatment component 120 defines two resonance chambers 138, 140. The first resonance chamber 138 is defined by a first perforated wall 142 and a center wall 144. The second resonance chamber 140 is defined by a second perforated wall 146 and the center wall 144. The center wall 144 is typically a solid wall. The distance between the first perforated wall 142 and the center wall 144 and the distance between the second perforated wall 146 and the center wall 144 are determined by the primary frequency of the engine noise that the exhaust muffler 100 attenuates. In one embodiment, the volume of the acoustic treatment is about 12 cubic inches for each resonance chamber 138, 140. The perforations defined by each perforated wall 144, 146 have a diameter approximately equal to the thickness of the respective perforated wall 144, 146. In one embodiment, the perforations in each perforated wall 144, 146 are, for example, about 0.050 inches, although the size of the perforations can be adjusted. Based on the volume of the resonance chambers 138, 140, the primary frequency or frequencies are damped by the resonance chambers 138, 104.

The exhaust muffler 100 is generally self-supporting. Coupling the arms 106, 108 together can result in the exhaust muffler not requiring additional mounting structures in or on the aircraft 101. The exhaust muffler 100 can be machined or molded from any suitable material for handling exhaust from the turbine engine 104. In one embodiment, the exhaust muffler 100 can be manufactured from steel, for example, stainless steel. The perforations 122, 124 can be punched into the arms 106, 108 with a suitable tool, or the perforations 122, 124 can be formed in the arms 106, 108 with a laser.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An exhaust muffler for a turbine engine with at least first and second exhaust outlets, the exhaust muffler comprising:

a first arm configured to be coupled to the first exhaust outlet of the turbine engine, the first arm including an outer surface, and an inner surface that defines a first exhaust cavity, and further includes a plurality of perforations extending between the inner and outer surfaces; and a second arm coupled to the first arm and configured to be coupled to the second exhaust outlet of the turbine engine, the second arm including an outer surface, and an inner surface that defines a second exhaust cavity, and further including a plurality of perforations extending between the inner and outer surfaces, wherein the first arm has first and second ends and the second arm has first and second ends, the first end of the first arm being configured to be coupled to the first exhaust outlet of the turbine engine, the first end of the second arm being configured to be coupled to the second exhaust outlet of the turbine engine, and the second end of the first arm being coupled to the second end of the second arm.

2. The exhaust muffler of claim 1, wherein the turbine engine is installed in an unmanned aerial vehicle with a fuselage.

3. The exhaust muffler of claim 2, wherein the first and second arms extend from the turbine engine, out of the fuselage, and around at least a portion of the fuselage.

4. The exhaust muffler of claim 2, wherein the perforated portions of the first and second arms are separated from the fuselage by a distance of about 0.25 inches to about 0.5 inches.

5. The exhaust muffler of claim 1, wherein each of the perforations of the first and second arms are approximately circular with a diameter of about 0.20 inches.

6. The exhaust muffler of claim 1, wherein the perforations of the first and second arms have a total area of about 13 square inches.

7. The exhaust muffler of claim 1, wherein at least a portion of each of the first and second arms have a cross-section shaped like a half circle.

8. The exhaust muffler of claim 7, wherein the half circle has a radius of about 1.6 inches.

9. An exhaust muffler for a turbine engine with at least first and second exhaust outlets, the exhaust muffler comprising:

a first arm configured to be coupled to the first exhaust outlet of the turbine engine, the first arm including an outer surface, and an inner surface that defines a first exhaust cavity, and further includes a plurality of perforations extending between the inner and outer surfaces;

a second arm coupled to the first arm and configured to be coupled to the second exhaust outlet of the turbine engine, the second arm including an outer surface, and an inner surface that defines a second exhaust cavity, and further including a plurality of perforations extending between the inner and outer surfaces; and an acoustic treatment component coupling the first arm to the second arm.

10. The exhaust muffler of claim 9, wherein the acoustic treatment component defines at least one resonance chamber.

11. The exhaust muffler of claim 9, wherein the acoustic treatment component defines two resonance chambers.

12. The exhaust muffler of claim 11, wherein the two resonance chambers are defined by a first perforated wall, a second perforated wall, and a solid wall between the first and second perforated walls.

13. The exhaust muffler of claim 12, wherein the turbine engine produces a noise at a frequency, and the first perforated wall is separated from the solid wall at a first distance and the second perforated wall is separated from solid wall at a second distance, the first and second distance being adjusted such that the resonance chamber attenuates noise at the frequency.

14. The exhaust muffler of claim 13, wherein the resonance chambers each have a volume of about 12 cubic inches.

15. An exhaust muffler for a turbine engine with at least first and second exhaust outlets, the exhaust muffler comprising:

a first arm configured to be coupled to the first exhaust outlet of the turbine engine, the first arm including an outer surface, and an inner surface that defines a first exhaust cavity, and further includes a plurality of perforations extending between the inner and outer surfaces; and a second arm coupled to the first arm and configured to be coupled to the second exhaust outlet of the turbine engine, the second arm including an outer surface, and an inner surface that defines a second exhaust cavity, and further including a plurality of perforations extending between the inner and outer surfaces, wherein the turbine engine has a first axis and a second axis perpendicular to the first axis, the first and second exhaust outlets of the turbine engine each having a center line approximately parallel to the first axis, and the first and second arms are coupled together approximately on the second axis.

* * * * *